United States Patent [19]

Kalt

[11] 4,334,355

[45] Jun. 15, 1982

[54] SPAGHETTI EATING UTENSIL

[76] Inventor: H. Worthington Kalt, 173 N. Mountain Ave., Montclair, N.J. 07042

[21] Appl. No.: 236,004

[22] Filed: Feb. 19, 1981

[51] Int. Cl.[3] ..... A47J 43/28

[52] U.S. Cl. ..... 30/322

[58] Field of Search ..... 30/322

[56] References Cited

U.S. PATENT DOCUMENTS

| | | | |
|---|---|---|---|
| D. 25,384 | 4/1896 | Dazun | 30/322 |
| 2,710,449 | 6/1955 | Crino | 30/322 |
| 3,138,871 | 6/1964 | Sears | 30/322 |
| 3,552,017 | 1/1971 | Smuts | 30/322 |
| 3,609,865 | 10/1971 | Golden | 30/322 |

FOREIGN PATENT DOCUMENTS

| | | | |
|---|---|---|---|
| 14918 | of 1886 | United Kingdom | 30/322 |
| 251817 | 5/1926 | United Kingdom | 30/322 |
| 382319 | 10/1932 | United Kingdom | 30/322 |

*Primary Examiner*—Nicholas P. Godici
*Assistant Examiner*—J. T. Zatarga
*Attorney, Agent, or Firm*—Anthony H. Handal; Michael N. Meller

[57] ABSTRACT

A fork 10 for winding spaghetti 30 which is spun by displacing the user's hand along grooves of a track 14 on handle 12 from point 16 to point 18 is disclosed. The speed of rotation increases as the user's hand approaches support plate 20 because the pitch of the grooves in track 14 increases. In one embodiment the center prong 22 is longer than prongs 24, and edges 32 of prongs 24 are straight and parallel to axis 26. The added length of center prong 22 facilitates rotational movement around axis 26. Straight edges 32 facilitate both the winding of spaghetti 30 around fork 10 and removal of the wound spaghetti for consumption.

3 Claims, 4 Drawing Figures

SPAGHETTI EATING UTENSIL

BACKGROUND ART

Use of a fork in eating spaghetti requires a spinning motion to wind the spaghetti around the fork. Use of a fork requires many hand and finger movements to create the required spinning motion. These motions are tedious and, for some, difficult, and reducing them would simplify the process for spinning spaghetti onto the fork. Reducing these motions would alleviate the tedium of children at meals and assist invalids who find the presently required movements difficult.

While mechanical devices for achieving an angular velocity in table utensils are known, an effective mechanism for rotating a utensil and effectively winding spaghetti onto it is not known.

DISCLOSURE OF THE INVENTION

The invention, as claimed, is intended to provide a remedy. It solves the problem of how to efficiently and easily wind spaghetti onto a utensil.

The advantage offered is that the inventive utensil can be spun through many revolutions by a single, simple hand motion. The speed of the revolutions is increased as the single motion progresses and the initial reluctance of the utensil to spin and the spaghetti to wind is overcome.

Rotational movement of the utensil is facilitated by a center prong, which, in one embodiment is slightly longer than other prongs in the device. Efficiency in winding the spaghetti and removing it from the utensil in that embodiment is also obtained by having straight outer edges on the outer prongs.

BRIEF DESCRIPTION OF THE DRAWINGS

One way of carrying out the invention is described below with reference to drawings, in which.

BEST MODE FOR CARRYING OUT THE INVENTION

Figure 1:
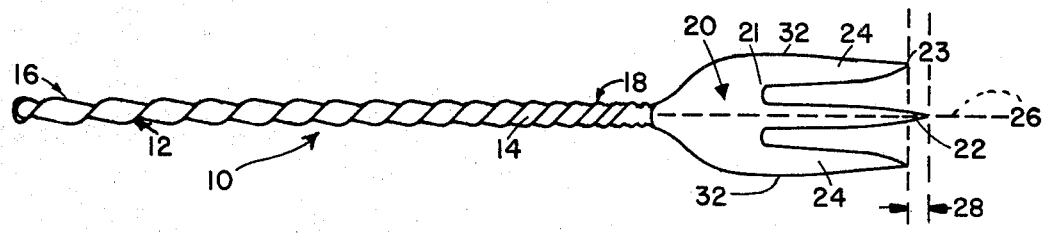
FIG. 1 is a plan view of a fork in accordance with the invention.

FIG. 1 shows a fork 10 for winding spaghetti comprising a handle 12 having a track 14 and ends 16 and 18 which is welded to a support plate 20 which is integral with fork prong 22 and prongs 24. Handle 12 is grooved with a spiral track 14. The pitch of track 14 is greater at end 18 of handle 12 than it is at end 16 of handle 12. This results in more turns of track 14 per unit length of handle 12 at end 18 than at end 16 of handle 12.

Support plate 20 is substantially of a curved planar shape and connects handle 12 to prong 22 and prongs 24. Prongs 22 and 24 are wide at their bases 21 where they meet support plate 20 and taper to sharp points 23 at their tips. Edges 32 of prongs 24 are straight and substantially parallel to the axis 26 of handle 12. Prong 22 is slightly longer than prongs 24. This difference in length is indicated as distance 28 in FIG. 1.

The spiral track of handle 12 is used to cause rotation of the fork as the user's hand is displaced along handle 12 from point 16 to point 18. The pitch of the track at point 16, with fewer turns of track 14 per unit length than at point 18, facilitates starting the spin of fork 10 by minimizing resistance to hand motions. Once this initial resistance is overcome the pitch of track 14 is changed to increase the speed of rotation. Thus, as the user's hand is displaced along handle 12 towards point 18, the pitch of track 14 increases to increase the speed of rotation of fork 10. This combination of pitches makes fork 10 more efficient by maximizing the speed of rotation while also affording ease in overcoming initial resistance to rotation.

Prong 22 is longer than prongs 24 by distance 28 to facilitate the rotation of fork 10 and to prevent interference by prongs 24 during that rotation. This interference would consist of a prong 24 catching the surface with which prong 22 is in contact during rotation. Variation in the position of the user's hand during displacement along handle 12 could tip fork 10 to the side, at which point a prong 24 would catch and become a new center of rotation for the fork 10. Extending prong 22 helps to overcome such interference from prongs 24 by making it less likely that a prong 24 would catch if the fork 10 were tipped as described above.

Figure 3:
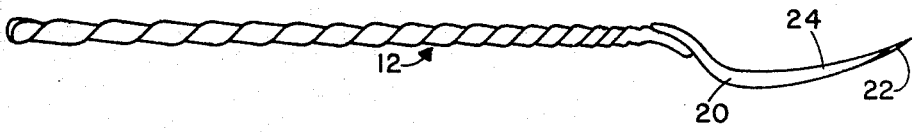
FIG. 3 is a side view of the invention as illustrated in FIG. 1.

The distance 28 between prongs 22 and 24 should be slightly less than one-fourth the diameter of common spaghetti 20, which is shown in cross section. (FIG. 3). Distance 28 and the size of the spaghetti is greatly exaggerated to illustrate a principle of the invention. This is to maximize the efficiency of winding the spaghetti 30 around fork 10. If distance 28 is greater than one-fourth the diameter of common spaghetti 30, at tilted fork positions the prong 24 will be more than half the spaghetti's diameter away from the plate and will thus tend to compress and slide over spaghetti 30 as the rotational movement forces spaghetti 30 under prong 24. This result is unsatisfactory because the leverage of prongs 24 gained by their being away from the center of rotation at point 23 of prong 22 would be lost until the distance 28 has been filled with spaghetti 30. Restricting distance 28 to less than one-fourth the diameter of common spaghetti 30 will press spaghetti 30 against edge 32 of prong 24 rather than allowing prong 24 to slide over spaghetti 30.

Edges 32 of prongs 24 are substantially straight or inclined very slightly with respect to axis 26 of handle 12 to make winding of the spaghetti 30 around fork 10 more efficient. If edges 32 are tapered more significantly towards axis 26 the force of spaghetti 30 against prong 24 will tend to promote the problem of prong 24 sliding over spaghetti 30, as discussed above. This is because spaghetti 30 will have a tendency to slide toward the tip 23 of prong 24 rather than remain stationary on edge 32. Likewise, if edge 32 were tapered out, away from axis 26, the spaghetti 30 will be difficult to remove from fork 10. Furthermore, such an unorthodox configuration would increase the hazard to the user of poking himself in the lips, gums, or tongue with prongs 24.

The invention offers ease and efficiency in spinning the fork 10. This is accomplished by the grooves of track 14 along handle 12 and the extended tip 23 of prong 22. The grooves on handle 12 overcome initial resistance to rotation and gradually increase the speed of rotation. The extended tip 23 of prong 22 decreases the likelihood that prongs 24 will catch the plate surface. Edges 32 also facilitate winding and removal of spaghetti from fork 10.

In use, the tip 23 of prong 22 is placed against a plate while handle 12 is grasped. The fork is substantially vertically positioned with respect to the plate with point 16 between the user's fingers. As the user's hand is displaced downwardly along handle 12 and a finger tip engages track 14, the downward movement toward point 18 spins fork 10 with increasing speed. This causes rotational movement which winds spaghetti 30 around the fork prongs and against edges 32. The spaghetti 30 can then be removed from the fork 10 in the ordinary manner.

Figure 4:
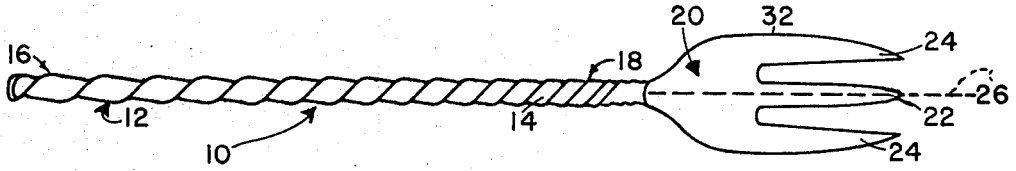
FIG. 4 is a plan view of an alternative embodiment.
Figure 2:
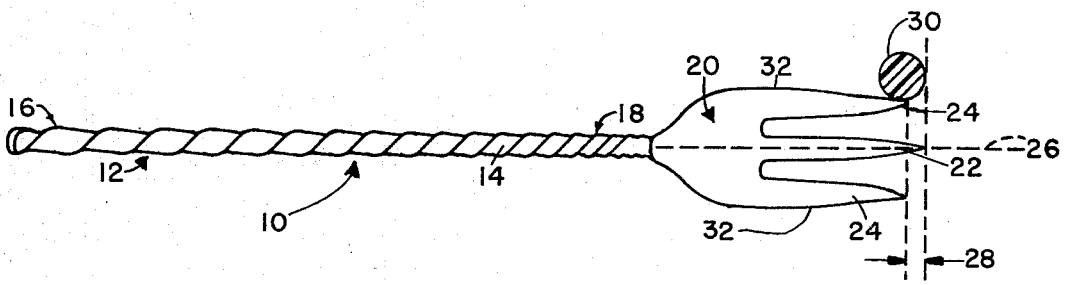
FIG. 2 illustrates the operation of the embodiment illustrated in FIG. 1.

In an alternative embodiment of the invention illustrated in FIG. 4, where parts performing corresponding functions given identical reference numerals, prong 22 and prongs 24 are of equal length and edges 32 taper slightly towards tip 23 of prongs 24. These alterations give the invention a more conventional appearance which may be more aesthetically pleasing to the user. The absence of these two features found in the FIG. 1 embodiment will affect performance of the invention, but to some users the more conventional appearance may be worth the slight loss in efficiency.

While an illustrative embodiment of the invention is described, it is, of course, understood that various modifications will be obvious to one of ordinary skill in the art. For example, the fork may be made of one piece of metal instead of a handle welded to the prong portion of the fork. Such modifications are within the spirit and scope of the invention which is limited and defined only by the appended claims.

I claim:

1. A fork for simplifying the operation of picking up spaghetti, comprising:

(a) an elongated handle with a length much greater than its diameter;

(b) support plate means disposed at one end of said elongated handle;

(c) prongs disposed at the end of said support plate means opposite from said elongated handle, said prongs being oriented with their length substantially parallel to the axis of said elongated handle; and (d) a spirally configured track disposed along the length of said elongated handle, said spirally configured track being of variable pitch, with more turns per unit length adjacent said support plate means.

2. A fork as in claim 1 wherein there are an odd number of prongs.

3. A fork as in claim 2 wherein one of said prongs is disposed along the axis of said handle and is longer than the other prongs.

* * * * *